United States Patent [19]

Castiglioni

[11] Patent Number: 4,617,819

[45] Date of Patent: Oct. 21, 1986

[54] WIRE CUTTING AND FORMING MACHINE WITH BALANCED MASSES

[76] Inventor: Albino Castiglioni, Via Losanna 12, 6900 Lugano, Switzerland

[21] Appl. No.: 642,769

[22] Filed: Aug. 21, 1984

[30] Foreign Application Priority Data

Aug. 23, 1983 [CH] Switzerland ..... 4587/83

[51] Int. Cl.[4] ..... B21D 7/06

[52] U.S. Cl. ..... 72/407; 72/443; 72/453.08

[58] Field of Search ..... 72/407, 441, 443, 453.1, 72/453.08

[56] References Cited

U.S. PATENT DOCUMENTS 3,261,197 7/1966 Weyer ..... 72/407

*Primary Examiner*—W. D. Bray

*Attorney, Agent, or Firm*—Young & Thompson

[57] ABSTRACT

The device is applicable to a cutting and pressing machine, in particular to a machine for continuous cutting and cold pressing of material supplied in the form of wire, a machine that comprises: rolls (7,7'-7'',7''') for feeding of the wire (2) and a press slide (3) with press punches. The device provides that these known elements (A) are made to operate in opposition and synchronization with respect to other elements (B) which are opposite and equivalent in mass and distance of travel with respect to a common center (C). In this way a total stability of the machine is achieved with the consequent possibility of increasing the speed and therefore hourly production with respect to known machines, of pieces, such as screws, bolts and the like.

4 Claims, 2 Drawing Figures

WIRE CUTTING AND FORMING MACHINE WITH BALANCED MASSES

This invention relates to a device for balancing masses to allow an increase in the operating speeds of cutting and pressing machines, particularly in machines for continuous cutting and cold pressing of material supplied in the form of wire, machines comprising the following elements: wire feed rolls, press slide and press punch holder.

It is known that in machines exhibiting elements subjected to a continuous reciprocating movement, the machine itself is subjected to the same continuous stresses which, in turn, have a negative influence on the operating speed and cause rapid wear of all the component parts. The device, object of the invention, is characterized by the fact that said elements are made to operate in opposition and synchronization with respect to other elements which are opposite and equivalent in mass and distance with respect to a common center.

In completing the continuous movements of said elements, i.e., of the wire feed rolls and the press slide, any transmission of vibrations to the machine is eliminated completely from the start, enabling all the component parts to operate in an ideal way and to provide a notable increase in hourly production of pieces.

The device, object of the invention, lends itself advantageously to being applied to the machine that is the object of Swiss patent application No. 7004/81-0 of the applicant.

For greater clarity, the accompanying drawings show a preferred embodiment of the device, object of the invention. Specifically:

FIG. 1 shows the arrangement of the various elements in a machine for production of screws, bolts and the like;

Figure 1:
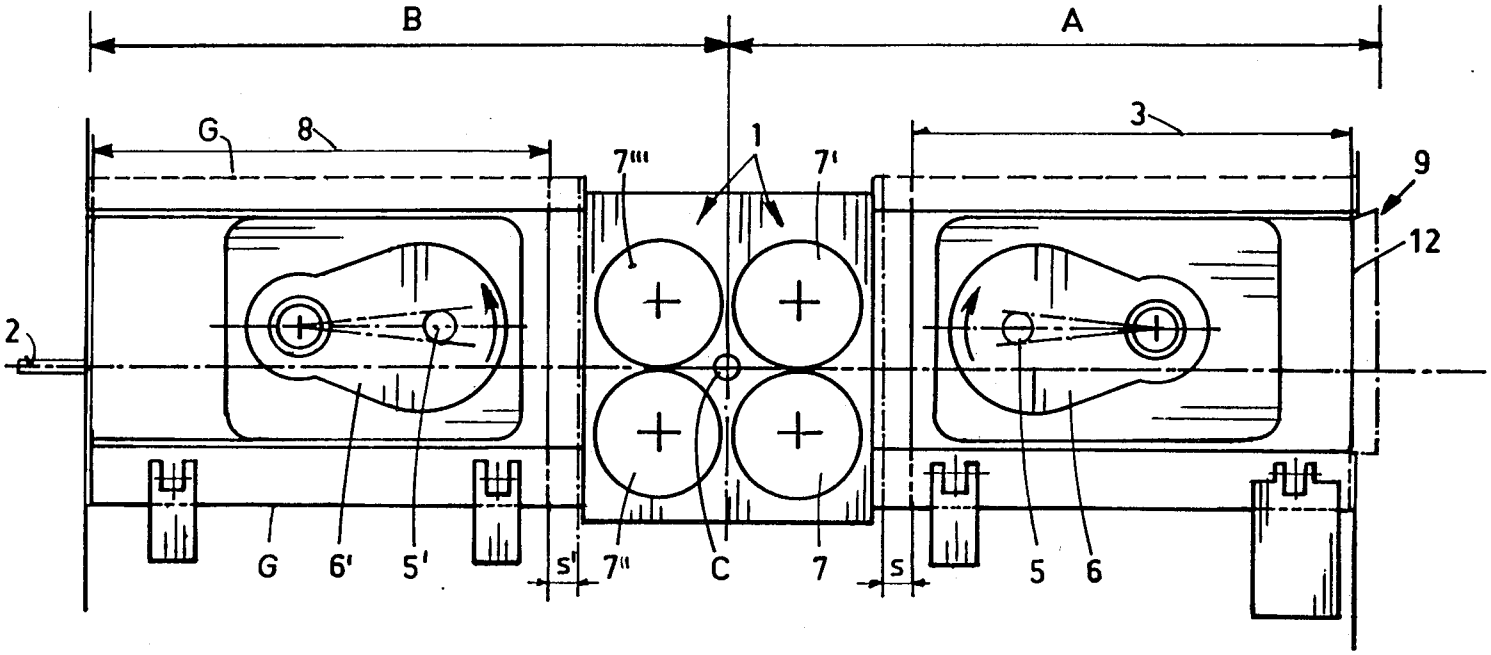

With reference to the drawings, the machine for continuous cutting and cold pressing of material, which is supplied in the form of wire, comprises a group of first elements A, namely, rolls for intermittent feeding of wire 2, a press slide 3 and a pressing unit 9. The machine itself further comprises a group of second elements B, opposite and equivalent in mass and distance of travel with respect to the common center C.

Press slide 3, which is used for pressing or cold deformation of the piece of cut wire, is subjected to a reciprocating movement s in a plane parallel to the supplied material 2. The intermittent movement of said slide occurs by means of an eccentric shaft 5 operated by a drive shaft and transmitting reciprocatory movement to slide 3 by a connecting rod 6.

The wire feed, belonging to said first element A, consists of a first pair of rolls 7, 7', which rotate in opposite directions and in concordance with one another.

Elements B are opposite and equivalent in their mass and their distance of travel to the first elements A with respect to a common center C. These latter elements also comprise a pair of rolls 7'', 7''', which rotate in opposite directions and in concordance with one another. Advantageously, the axes of rotation of the four rolls 7, 7'-7'',7''' for feeding the material are placed at the vertices of a quadrilateral, whose center of gravity constitutes said common point C.

With reference to the input of wire 2 in the machine, the last feed rolls 7'', 7''' are preceded by a balancing slide 8, also subjected to the action of an eccentric shaft 5' operated by a motor by a connecting rod 6'. This eccentric shaft and connecting rod impart to slide 8 the reciprocatory movement s' in opposition and synchronization with respect to press slide 3, which carries the punches, better described below.

Advantageously, the first pair of feed rolls 7, 7' and second pair 7'', 7''', as well as press slide 3 and balancing slide 8 are opposite and equivalent in their mass and distance of travel with respect to common center C, as already mentioned.

The use of a double group of feed rolls 7, 7' and 7'', 7''' and of elements 3, 5, 6 and 8, 5', 6' opposite and equivalent in mass and in distance of travel, contributes to achieving the total stability of the machine.

Figure 2:
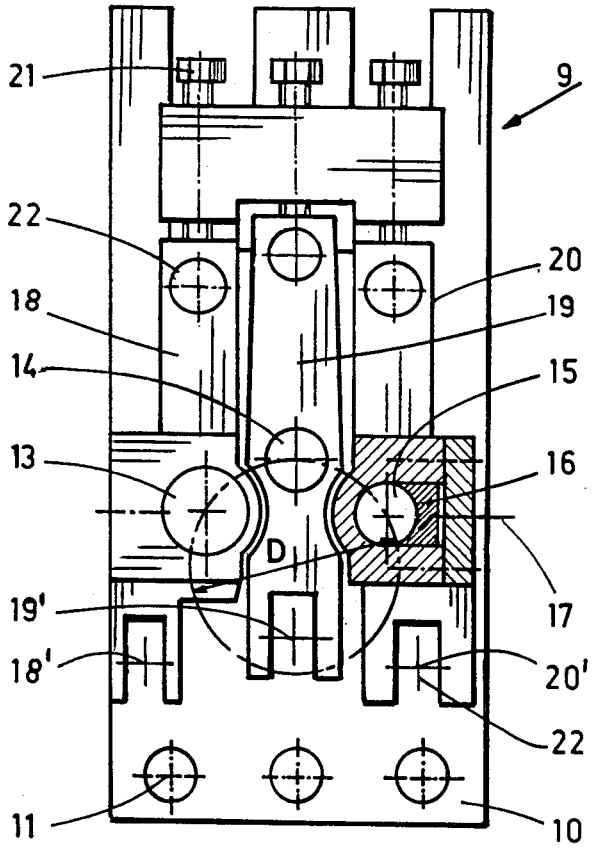
FIG. 2 shows the front view of a punch holder, from the right of FIG. 1, solid with the press slide.

As already indicated, the pressing unit or punch holder 9, shown in FIG. 2, lends itself in a particular way to compensation of the masses and distances. It comprises a base 10, which, by screws 11, which can be fastened to the respective head 12 of press slide 3. On diameter D of a circle are distributed two (13, 15) or even three punches 13, 14, 15, for cold pressing cut-off portions of supplied material upon reciprocation of press slide 3 by which they are carried. These punches are in turn locked in place by catches 16 and respective screws 17. Said punches are each mounted on punch holders 18, 19, 20 which can be directed angularly and independently of the others from their base 18', 19', 20'.

At the same time, the punch holder supports can be moved linearly and fixed upward and downward by screws 21 and bolts 22.

In this way, an easy interchangeability of the punches is achieved.

I claim:

1. In a machine for the continuous cutting and cold pressing of material supplied in the form of wire, the machine having a plurality of wire feed rolls for intermittently feeding wire toward a cutting and cold pressing station, a cold pressing punch holder slidably mounted on the machine, and means for reciprocating the punch holder in a direction toward and away from the wire feed rolls and parallel to the direction of advance of the wire; the improvement comprising a body of substantially the same mass as the punch holder, said feed rolls being disposed between said body and said punch holder, said body being mounted on the machine for sliding movement toward and away from the feed rolls in a direction parallel to the direction of movement of the wire, and means for reciprocating said body equal distances as, but in opposite directions from, said punch holder, said body and said punch holder being disposed at all times equal distances from said wire feed rolls.

2. A machine as claimed in claim 1, there being four of said wire feed rolls disposed in quadrilateral configuration about a center disposed at the intersection of two imaginary lines each of which interconnects the axes of two diagonally opposite said feed rolls, said wire passing through said center.

3. A machine as claimed in claim 1, and rotatable eccentric shafts mounted on the machine for reciprocating said punch holder and said body, said shafts rotating about axes interconnected by an imaginary line parallel to said wire.

4. A machine as claimed in claim 3, said axes being equal distances from said center.

* * * * *